United States Patent [19]

Morris

[11] 4,448,839

[45] * May 15, 1984

[54] METHOD OF SIZING HYDROPHOBIC YARN

[75] Inventor: Hal C. Morris, Warminster, Pa.

[73] Assignee: Rohm and Haas Company, Philadelphia, Pa.

[ * ] Notice: The portion of the term of this patent subsequent to Jul. 19, 2000 has been disclaimed.

[21] Appl. No.: 312,761

[22] Filed: Oct. 20, 1981

Related U.S. Application Data

[63] Continuation-in-part of Ser. No. 311,561, Oct. 16, 1981, abandoned, and Ser. No. 202,543, Oct. 31, 1980.

[51] Int. Cl.[3] ..... B32B 7/00; B65B 33/00; B05D 3/02

[52] U.S. Cl. ..... 428/267; 8/115.6; 252/8.6; 427/155; 427/389.9; 427/393.4; 427/401; 428/245; 428/265

[58] Field of Search ..... 427/389.9, 393.4, 155, 427/401; 428/245, 265, 394, 224, 267; 8/138, 115.6; 28/166; 252/8.6, 8.9

[56] References Cited

U.S. PATENT DOCUMENTS

| | | | |
|---|---|---|---|
| 2,807,865 | 10/1957 | Shippee | 28/76 X |
| 3,676,207 | 7/1972 | Lofton et al. | 28/167 X |
| 4,015,317 | 4/1977 | Johnsen | 28/72.6 |
| 4,033,922 | 7/1977 | Baron et al. | 28/76 X |
| 4,106,900 | 8/1978 | Perkins | 28/168 X |
| 4,239,671 | 12/1980 | Fink et al. | 28/76 X |
| 4,248,755 | 2/1981 | Williams | 28/167 X |
| 4,312,914 | 1/1982 | Guth | 427/393.4 X |

*Primary Examiner*—Thurman K. Page

*Attorney, Agent, or Firm*—Michael B. Fein; Harold L. Greenwald; George W. F. Simmons

[57] ABSTRACT

A method of sizing a hydrophobic yarn for weaving comprising the steps of applying thereto an acid pH latex of a free radical initiated vinyl polymer and drying the yarn. The polymer has a weight average molecular weight of from about 300,000 to about 2,500,000, and in dried film form is hydrophobic, not redispersible in a solution at a low pH and redispersible in an alkaline aqueous medium. The polymer is prepared from monomers comprising about 8% to about 14%, by weight ethylenically unsaturated acid. The average solubility parameter of the monomers in the polymer is between about 9.0 and about 9.5; the calculated polymer $T_g$ is between about −20° C. and 20° C. Preferred yarns are nylon and polyester.

13 Claims, No Drawings

METHOD OF SIZING HYDROPHOBIC YARN

This application is a continuation-in-part of application Ser. No. 311,561 filed Oct. 16, 1981, now abandoned, and of Ser. No. 202,543 filed Oct. 31, 1980.

BACKGROUND OF THE INVENTION

This invention relates to the sizing or dressing of yarns whether of spun or continuous filament type, to render them amenable to textile operations, for example, twisting, doubling, weaving, knitting, braiding and so forth. It is particularly concerned with sizes of the removable type which are adapted to be applied to hydrophobic yarns, such as polyester or nylon yarns, and especially yarns for use in water jet looms.

Various water-soluble or highly water dispersible polymeric colloidal substances, such as starch, polyvinyl alcohol and acid rich acrylic copolymers have been used for the sizing of yarns including moderately hydrophobic yarns such as nylon yarn, but such materials generally show insufficient adhesion to the more hydrophobic yarns such as polyester. This lack of adhesion requires the application of excessive amounts of sizing material to protect the filaments or fibers or to compensate for the tendency for the size to rub off on guides and other surfaces of the textile fabricating machinery. A suitable polymeric size must not be so hard or brittle as to shed particles during passage through the textile fabricating machinery nor may it adhere to the metal in preference to the fiber or yarn and in this way lead to deposits of size materials being left on metal drives or drying drums during the processing. Sizing of yarns for use in water jet looms presents particular problems because the shed opening on the looms is very small and electronic controls may be so fine that fuzzy yarns either transfer with the jets or tend to trip the stop motion in electronically controlled units which then stop the loom abruptly.

The acrylic copolymer size of the instant invention has excellent adhesion to a wide range of hydrophobic yarns and does not require extremely stringent drying conditions in order to develop good water resistance. Despite being highly hydrophobic, the polymer is readily removable with a mild alklaine scour and thus is an excellent warp size for yarns to be woven on a conventional shuttled or shuttless loom or preferably on a water jet loom. Additionally, the polymer is tack-free in film form and, being a latex emulsion as prepared, is readily amenable to dilution and dries easily under moderate conditions to a water-resistant tack-free polymer.

BRIEF DESCRIPTION OF THE INVENTION

This invention is a method of sizing hydrophobic yarns for weaving. The method comprises the steps of applying a certain latex to the yarn and drying the treated yarn. The latex has an acid pH and is a latex of a free radical initiated vinyl polymer having a weight average molecular weight between about 300,000 and about 2,500,000. Said polymer, in dried film form, is hydrophobic and is not redispersible in an aqueous solution at a low pH, such as from about 2 to about 5 or preferably even to 7, and is redispersible in an alkaline aqueous medium. The polymer is a polymer of monomers having a volume average solubility parameter (S. P.) between about 9.0 and about 9.5; the monomers comprising about 8% to about 14% $\alpha$-$\beta$- ethylenically unsaturated acid. The glass transition temperature (Tg) of the polymer is between about −20° C. and 20° C.

DETAILED DESCRIPTION

The polymer latex of the instant invention is made, preferably by a gradual addition thermal process, at about 30% to 60% solids following conventional emulsion polymerization procedures such as taught in the books entitled *Emulsion Polymerization* by D. C. Blackley (Wiley, 1975) and by S. A. Bovey et al (Interscience Publishers, 1965) and *Applications of Synthetic Resin Emulsions* by H. Warson (E. Benn, Ltd., 1972) and *Emulsion Polymerization of Acrylic Monomers* (Rohm and Haas Co. bulletin CM104A/cf) all herein incorporated by reference. The polymer is preferably a linear polymer free of crosslinks and branch points. In one desirable embodiment, the polymer is prepared from monomers consisting essentially of, by weight, 45–65% butyl acrylate, 28–45% styrene or methyl methacrylate or a mixture thereof, 8–14% acrylic acid or methacrylic acid or a mixture thereof; preferably the monomers consist essentially of 50–60% butyl acrylate, 28–40% styrene and 10–13% acrylic acid or methacrylic acid. The polymer has a weight average molecular weight of from about 300,000 to about 2,500,000 with 500,000 to about 2,000,000 being preferred and 600,000 to 1,500,000 being most preferred.

The polymer latex size forms a film on a hydrophobic yarn, preferably a polyester such as polyethylene terephalate or a nylon such as nylon 66, or nylon 6. The film has excellent adhesion and flexibility thus providing a hard, tough, protective film unaffected by the abrasive action of looms, particularly water jet looms, and by humidities up to 100%. The polymer is easily removed by scouring with dilute aqueous solutions of alkaline materials.

The hydrophobic yarn of this invention comprises fibers which exhibit moderate to little uptake of water upon immersion in water or exposure to high humidity. This property is often measured by adsorption of water by a polymer film having a composition corresponding to that of the fiber or by the moisture regain or uptake of dehydrated fibers when held in an atmosphere of fixed relative humidity. Sources of such data are J. R. Scott and W. J. Roff, et al., *Handbook of Common Polymers*, CRC Press, Cleveland, Ohio, 1971; E. Sutermeister, *Chemistry of Pulp and Paper Making*, John Wiley & Sons, New York, 1941; and the periodical *Textile World*, McGraw-Hill Publications, Atlanta, Georgia. The following table is abstracted from the 1978 Textile World Man-Made Fibers Chart, herein included by reference on page 51 et seq. of the August 1978 *Textile World*.

| Fiber | Moisture Regain (%/70° F./65% RH) |
|---|---|
| Polyethylene Terephthalate | 0.4 |
| Nylon 6 | 2.8–5.0 |
| Nylon 66 | 4.0–4.5 |
| Viscose Rayon | 11–13 |
| Cellulose Acetate | 2.5–6.5 |
| Acrylic (AN) | 1.0–2.5 |
| Modacrylic | 2.5–3.0 |
| Polyethylene | negligible |
| Polypropylene | 0.01–0.1 |
| Aramid | 4–7 |
| Kelvar ®, Nomex ®-DuPont) | |
| Teflon ® (DuPont) | 0 |
| Spandex (polyurethane) | ca. 1 |

-continued

| Fiber | Moisture Regain (%/70° F./65% RH) |
|---|---|
| Glass | none |

Hydrophobic fibers are fibers wherein the moisture regain is about 5% or less, preferably between about 4.5%, and about 0.1% and most preferably between about 3% and 0.2% of the fiber weight at 70° F. and 65% R. H. The yarn of the present invention preferably comprises at least about 50% by weight of such hydrophobic fibers; more preferably the yarn consists essentially of hydrophobic fibers and most preferably entirely of hydrophobic fibers, especially 100% polyester fibers, such as poly (ethylene terephthalate), and 100% nylon fibers.

The amount of copolymer applied to the textile material may vary from about 1 to about 20% by weight of yarn depending on the purpose for which the application is intended and on whether or not auxilliary conditioning or sizing agents are included in the composition when it is applied to the textile. The latex may be applied by spraying, dipping, padding, by sizing rolls, transfer rolls or the like. An entire warp may be passed through a conventional slasher or a yarn may be individually treated in a single end sizer. The latex may have a concentration of 1–25% by weight solids in the aqueous system and excess may be removed, such as by squeeze rolls or wipers, and the treated yarn may then be dried. Drying may be effected by any suitable means such as by heated air or drying cans. Drying may be effected at a wide range of temperatures such as 70–120°C. The aqueous latex may be applied at room temperature or at elevated temperatures such as up to about 80° C. For warp sizing of spun yarns the preferred proportion of polymer applied to the yarn is from 5–15% by weight of the initial weight of the yarn. For the sizing of continuous filament yarns, including water jet loom sizing, the preferred proportion is from about 1% to about 10% copolymer on the weight of the yarn. The higher amount of size is needed for fine (low) denier zero or low twist yarn.

The copolymer of this invention may be applied to yarns to modify their properties and especially to render them more amenable to textile processing operation. Although not necessary, auxiliary materials may be incorporated into the latex such as surfactants or water dispersible lubricants, including sulfonated oils, self-dispersible waxes, swelling or plasticizing agents for the yarn, etc.

The article obtained, after application of the sizing composition to the yarn and drying, is essentially free from the disadvantage of developing static charges and loss of sizing material by transfer to guides or by shedding. Surprisingly, the sizing material is readily removed by common scouring operations because of the ready solubility in aqueous alkaline medium despite its marked hydrophobicity, affinity for hydrophobic fibers and insolubility in acid medium. Even mildly alkaline scour solutions, such as 0.15% soda ash, are completely effective in removal of this polymer. Such mildly alkaline solutions may have a pH about 11.

Various tests are employed to gauge the suitability of the polymer latex for use in sizing polyester yarn. The test methods are described below; in the examples there are data comparing polymers of the instant invention with materials of the prior art and with examples of polymer latices outside the bounds of the instant invention.

The adhesion of the polymer to the yarn as measured by the Sand Tumble Test, described below, guages how well a yarn bundle will resist abrasion on the loom. Run under dry conditions the test relates to performance on a standard loom and run under wet conditions the test relates to performance on a water jet loom. A value of 50 is considered acceptable although 75 is preferred and values about 100 are most preferred.

The Adhesion to Mylar ® Test is indicative of adhesion, especially to a polyester substrate since Mylar is a polyester substrate. The Crinkle Test gives the tendency of the polymer to flake from the substrate under flexing, thus simulating a yarn going over a roller or a guide. Flaking under such conditions would cause a weak spot in the yarn and thus lead to breaks in the yarn on the loom. The Scrape Test is to simulate the action at drop wires or a reed in the loom and also gives a gauge of the film toughness which property is required for runability in a mill.

Water Resistance Tests measure a property needed for good performance in a water jet loom. Low water resistance is indicative of high swelling which leads to a markedly weaker film and thus to a weak sized yarn. The Moisture Regain measure, being at 95% relative humidity, additionally indicates the stability of the sized yarn to changes in ambient conditions such as seasonal or from dry day to humid day.

Tack Test measures the ability of the sized and dried yarn to be rolled on a beam while warm and then be unrolled from the beam without sticking.

Removability of the size is, of course, essential with the final test of removability from the sized yarn being most important. The size should be completely removable from the yarn.

The polymer of the instant invention is applied to the yarn in the form of a latex of particles usually about 0.07 to about 0.25 microns diameter, with 0.10 to 0.18 being preferred and about 0.14, or a range within about 0.02 of that value, being most preferred. Polymerization procedures useful in producing polymers of the desired particle size and molecular weight are given in the books referred to above. This highly hydrophobic polymer composition is applied at acid pH and is scoured at basic pH thus the polymer is intrinsically stronger, as a size, than a solution polymer would be in this application. The solution polymer would have to be at least partially neutralized to be in aqueous solution and thus would be highly swollen and weaker than the very hydrophobic latex polymer at low pH, of the instant invention. If attempts are made to have the solution polymer be more hydrophobic, and thus marginally soluble, then the difficulty of scouring increases. A further advantage of utilizing a latex versus an alkaline solution or dispersion of a polymer is that less severe drying conditions are required for the latex, a particularly significant energy saving.

Alternative embodiments of the instant invention may employ other ethylenically unsaturated monomers in the preparation of the polymer latex. In alternative embodiments it is preferred that the acid content and identity be the same as in the above-described embodiments although other $\alpha$–$\beta$ ethylenically unsaturated acids, such as itaconic acid, may be used. The acid level remains at 8% to 14% with 10% to 13% being preferred. Replacements for the butyl acrylate, styrene and methyl methacrylate are made on the basis that the range of glass transition temperatures, ($T_g$), calculated for a high molecular weight polymer, and S. P. are to remain within the range implicit in the compositional range for the embodiments taught above. Likewise preferred and more preferred are ranges of $T_g$ and S. P. corresponding to the preferred and more preferred compositional ranges recited above.

Polymer Handbook, 2nd Edition, J. Brandrup and E. H. Immergut, editors (John Wiley & Sons, New York, 1975) section IV, part 15, entitled "Solubility Parameter Values" by H. Burrell, on pages IV-337 to IV-359, herein incorporated by reference, defines S. P., describes how it is determined or calculated, contains tables of S. P. and gives further references to scientific literature on S. P. Table I on pages IV-341 to 344 lists the S. P. of solvents, including many monomers thereunder. In this specification numerical values of S. P. have the dimensions (calories per cubic centimeter) to the one half power, i.e (cal./cc.) $_{0.5}$. The S. P. is the square root of the cohesive energy density which in turn is the numerical value of the potential energy of 1 cc of material, the potential resulting from the Van der Waals attraction forces between the molecules of a liquid or solid. Burrell describes a number of ways of calculating S. P. from experimentally determined physical constants and two ways of calculating them from the structural formula of a molecule. The structural formula methods are normally used when the data for the calculation from physical constants are not available or are considered particularly unreliable. Calculation from the structural formula utilizes tables of group molar attraction constants such as those given on pages IV-339. The table of Small is preferred. The S. P. concept may be considered an extension of the old rule "Like dissolves like." recognized since the early days of chemistry.

As tables of the solubility parameter of monomers are available, as noted above, it is convenient to define a polymer in terms of the solubility parameter of the monomers employed in its polymerization. The effective solubility parameter of a mixture is the sum, over the (i) components of the mixture, of the product of the volume fraction of the component (vi) times its S. P., i.e., S. P. (mixture)$=\Sigma V_i$(S. P.)$_i$ according to Scott and Magatt (See Encyclopedia of Polymer Science and Technology, Vol. 3, John Wiley, 1965, page 856). The volume fraction of each component is calculated from the weight fraction and the known density of the component of the monomer mixture assuming no changes in volume on mixing. Densities of the monomers are available in the usual sources such as *The Polymer Handbook, The Encyclopedia of Polymer Science and Technology,* and the manufacturers of the various monomers. The range of S. P. of the monomers employed in the polymers of the instant invention is from about 9.0 to 9.5 with the range 9.1 to 9.4 being preferred.

The calculated $T_g$ of a polymer is determined by the equation of T. G. Fox, Bull. Am. Physics Soc. 1,3, page 123 (1956) based on the $T_g$ of homopolymers of the individual monomers in the copolymer. Tables of the $T_g$ of homopolymers are given in "Polymer Handbook," section III, part 2, by W. A. Lee and R. A. Rutherford herein incorporated by reference. $T_g$ values referred to herein are calculated $T_g$ values for high molecular weight polymers. The polymers of this invention have a $T_g$ from about −20° C. to about 20° C. with the range −10° C. to +10°C. being preferred.

Other monomers which can be used in these alternative embodiments are preferably vinyl aromatic hydrocarbons, such as vinyl toluene and alpha methyl styrene; alkyl acrylates wherein the alkyl group has 1 to 8 carbon atoms, such as ethyl acrylate, propyl acrylate, and 2-ethylhexyl acrylate; alkyl methacrylates having 2 to 4 carbon atoms, such as ethyl methacrylate and isobutyl methacrylate and acrylonitrile.

The vinyl polymer used in the present invention is made as an aqueous dispersion of an emulsion polymer at about 40% to 60% by weight of polymer solids. Monomers can be selected from the group consisting of $C_2$-$C_{18}$ alkyl acrylates, $C_2$-$C_{18}$ alkyl methacrylates, vinyl aromatic compounds, vinyl halides, vinylidene halides, vinyl esters of saturated carboxylic acids, other polymerizable ethylenically unsaturated monocarboxylic and dicarboxylic acids and esters thereof, acrylonitrile, methacrylonitrile and alpha-olefins. Examples of the $C_2$-$C_{18}$ alkyl groups of the esters of acrylic and methacrylic acids which are useful in forming the polymers of this invention include methyl, ethyl, n-butyl, i-butyl, sec-butyl, t-butyl the various isomeric pentyl, hexyl, heptyl, and octyl (especially 2-ethylhexyl), isobornyl, decyl, lauryl, cetyl, stearyl and like groups. Examples of useful vinyl aromatic compounds include styrene and derivatives thereof such as vinyl toluene and alpha-methyl styrene; of vinyl and vinylidene halides are the corresponding chloride compounds; of vinyl esters of saturated carboxylic acids include vinyl acetate and vinyl propionate; of polymerizable ethylenically unsaturated monocarboxylic and dicarboxylic acids include acrylic acid, methacrylic acid, itaconic acid and crotonic acid; and of alpha-olefins include ethylene, propylene, and butylene.

In the following examples parts and percentages are by weight and temperature in degrees Celsius unless otherwise indicated. The examples illustrate the invention and are not to be construed as limiting the invention thereto. As given below, a general method was followed in the preparation of yarns and films. The method was followed throughout the examples unless an exception is noted in a given example. The same is true of the general test methods given below.

Preparation of Materials

Sized Yarns: The latex, at a pH of ca. 2.0 to 2.5 as prepared, or at a higher acid pH such as about 4 or 5, is diluted to 8% resin solids with water and applied to polyester or nylon filament yarn at room temperature on a laboratory size single end slasher. The slasher employs a double squeeze and consists of an immersion bath followed by a metal drum and two Teflon ®-coated drums, the first squeeze being between the metal drum and the first Teflon coated drum and the second squeeze between the two Teflon coated drums. The slasher is run at 4M/min and the sized yarn is dried 15 seconds thru a tube dryer set at 115° C. All sized yarn is conditioned one day at 21° C. and 60% R. H. before testing.

Film Preparation: 20 mil films are prepared by diluting the latex with water to the necessary solids content per volume. The diluted latex is then poured into a polypropylene culture dish, placed in a dust free area on a level surface, and air dried for 4 days or until a clear film is obtained. Thinner films (about 0.2 mils) are prepared by pouring a 15% solids latex, obtained by dilution with warm water (54° C.), onto a two mil Mylar ® sheet. The films are room dried overnight, then oven dried for one minute at 110° C.

Test Methods

Adhesion by Sand Tumble Test: The sized yarns are evaluated for wet and dry adhesion using laboratory sand tumble tests. Dry — Duplicate 3 yd. skeins of the sized yarn are placed in an 8 oz. jar containing 150g of coarse sand, rotated for 30 minutes on an Atlas Launder-ometer ®, removed and rated for % of the fiber bundle remaining intact. Wet — The same procedure is followed except the jar now contains 50g of sand and 150g water. Ratings are made the same way.

Adhesion to Mylar: The adhesion of the thin film is determined by two methods, scrape and crinkle. The scrape test consists of scraping the film with a razor blade and counting the number of strokes required to remove the polymer film from the polyester sheet. The crinkle test is designed to measure the film adhesion to polyester sheet by crumbling the sheet by hand and flattening it, noting any film separation from the Mylar. In the scrape test the results are classed as follows: Poor 1–2, Fair 3–4, Good 5 and Excellent 6 or more strokes. Crinkle test results are judged: Excellent—no change of Fair—cracks and slight film removal.

Water Resistance: The wet sand tumble test, previously noted, is a preliminary screen test of the water resistance. All additional testing of this property is conducted on the polymer films, either free or on Mylar, as follows: One inch squares of both the free and Mylar films are placed in 30° C. water for 30 minutes and evaluated for any change in clarity, toughness, adhesion, and size using the following ratings: Excellent=no change; Good=film swelling and Fair=-swelling and loss of toughness. The 20 mil free film is also evaluated for moisture regain when first bone dried and then subjected to 95% RH in a constant humidity chamber; the film is also observed for degree of haze developed.

Tack: The tackiness of the polymer is evaluated, immediately following one minute drying at 110° C., on the film cast on Mylar. For this evaluation, two films on Mylar are pressed film/film and then opened to gauge adhesion.

Removeability of the Size: This property is evaluated by two methods, alkali solubility of the film, and an actual scouring of sized yarn. Solubility of the film is determined by placing of a ¾" square of the 20 mil free film in a 1% $Na_2CO_3$ solution at 70° C. and recording the time it takes to dissolve up to 20 min. at which time the level of incomplete solution is gauged. The sized yarn is evaluated for size removal by scouring the yarn at 70–74° C. for 30 minutes in a 1.0% $Na_2CO_3$and 0.1% surfactant (Triton ®-X-100) bath with mild agitation. The yarns are rinsed five minutes in warm water (54° C.) and then cold water. The degree of removeability is determined by dyeing scoured and control yarns in Basic Red #14 at 60° C. and observing the dye pickup.

The following abbreviations are used in the examples below: BA butyl acrylate, St styrene, AA acrylic acid, MMA methyl methacrylate, MAA methacrylic acid, EA ethyl acrylate, EGDMA ethyleneglycol dimethacrylate, iBMA isobutyl methacrylate, VT vinyl toluene, MeST α-methyl styrene, AN acrylonitrile, 2-EHA 2-ethylhexyl acrylate, PMA propyl methacrylate, and EMA ethyl methacrylate.

EXAMPLE 1

Copolymers Containing 12% Acrylic Acid

Film and yarn are prepared using acrylic copolymer latex samples described in Table I below. The yarn being sized is Milliken textured polyester yarn, Saluda 373, 70 Denier, 33 filament, 1 twist. The test results, in Table I below, show that the samples varying in butyl acrylate content from 45% to 50.5% are all suitable sizing polymers compared to two commercial materials (1D, 1E). All of the examples exhibited no tack, except 1D which had slight tack when hot. The viscosity average molecular weight of the polymer of Example 1A is about 1.2 to 1.3 million.

EXAMPLE 2

Copolymers of 12% Methacrylic Acid

Using the same yarn as in Example 1 methacrylic acid containing polymers having 55–60% butyl acrylate are tested with the results found in Table II. An additional observation made is that the methacrylic acid samples produced less foam in the bath and during handling than the corresponding acrylic acid samples. All of the examples exhibited no tack. The weight average molecular weight of the polymer in Example 2C is about 600,000 to 700,000.

TABLE I

| Ex. | Composition | $T_g$ °C. | S. P.[5] | Sand Tumble Dry | Sand Tumble Wet | Film Solubility (min.) | Removability from yarn | Water Resistance of films 20 mil | Water Resistance of films Mylar | Adhesion to Mylar Scrape | Adhesion to Mylar Crinkle | Moisture Regain (%) |
|---|---|---|---|---|---|---|---|---|---|---|---|---|
| 1A[2] | 50.5 BA/37.5 St/12 AA | 3 | 9.4 | 100 | ca. 100 | Partial[1] | Complete | Exc. | No Change | Exc. | Exc. | 3.0 |
| 1B[2] | 50.5 BA/37.5 St/12 AA | 3 | 9.4 | 75–100 | 75 | Partial | Complete | Good | No Change | Exc. | Exc. | 3.7 |
| 1C | 45 BA/43 MMA/ 12 AA | 12 | 9.2 | 75–100 | 75 | <19 | Complete | Good-Exc. | No Change | Exc. | Exc. | 3.5 |
| 1D | Polyester[3] Eastman MPS | | | 50 | 25 | <4 | Complete | Good | No Change | Exc. | Exc. | 22.0 |
| 1E | Acrylic[4] ABCO FT-2B | | | ca. 100 | 75 | <20 | Complete | Exc. | No Change | Poor | Good | 11.0 |

[1]Partial - some film remaining after 20 minutes.
[2]Latex particle diameter is 0.10 micron in Example 1A and 0.21 in Example 1B.
[3]Applied as an 8% solids solution at a pH of 6.
[4]Applied as an 8% solids solution at a pH of 8.
[5]In (calories per cubic centimeter) 0.5

TABLE II

| Ex. | Composition | $T_g$ °C. | S. P. | Sand Tumble Dry | Sand Tumble Wet | Film Solubility (min.) | Removability from yarn | Water Resistance of films 20 mil | Water Resistance of films Mylar | Adhesion to Mylar Scrape | Adhesion to Mylar Crinkle | Moisture Regain (%) |
|---|---|---|---|---|---|---|---|---|---|---|---|---|
| 2A[1] | 57 BA/31 St/12 MAA | −1 | 9.2 | 75 | 75 | Partial | Complete | Exc. | No Change | Good-Exc. | Exc. | 2.0 |
| 2B | 60 BA/28 St/12 MAA | −5 | 9.2 | 50–75 | 50–75 | Partial | Complete | Exc. | No Change | Exc. | Exc. | 2.0 |
| 2C[1] | 57 BA/31 St/12 MAA | −1 | 9.2 | ca. 100 | ca. 100 | Partial | Complete | Exc. | No Change | Exc. | Exc. | 2.1 |
| 2D | 55 BA/33 St/12 MAA | 2 | 9.2 | 75–100 | 75 | Partial | Complete | Exc. | No Change | Good-Exc. | Fair | 1.8 |

[1]Latex particle diameter is 0.08 micron in Example 2A and 0.13 micron in Example 2C.

EXAMPLE 3

Compositional Variations

Polymer latexes of various compositions, as reported in Table III below, are used to prepare films and size yarns as in Example 1. The results in Table III indicate that the polymer based on ethyl acrylate (3C) has low adhesion, both by the sand tumble test and the two adhesion to Mylar tests, is high in moisture regain and produces a hazy film when tested for water resistance of a thin film on Mylar. Example 3D, having 4% acid in the copolymer, exhibits an insoluble film and less than complete removability from the yarn upon scouring and slightly hazy thin film on Mylar in the water resistance test. Example 3E, having 16% acid in the copolymer, also shows less than complete removability from the yarn on scouring and in addition has limited water resistance shown by both the 20 mil film and the thin film results. The only examples, in this group, exhibiting tack are 3C which has some tack when hot and 3D which has some tack even when cooled to room temperature .

EXAMPLE 4

Utilization of Other Monomers

Using the same yarn as in Example 1 other polymers are tested resulting in the data in Table IV. All of the examples are suitable for use in the water jet loom although Example 4A appears to be somewhat less so than the others.

TABLE IV

| Example | Composition | $T_g$ | S. P. | Sand Tumble[1] Dry | Sand Tumble[1] Wet | Film Solubility (min.) | Removability From Yarn | Water Resistance of Films 20 mil | Water Resistance of Films Mylar | Adhesion to Mylar Scrape | Adhesion to Mylar Crinkle | Moisture[2] Regain (%) |
|---|---|---|---|---|---|---|---|---|---|---|---|---|
| 4A | 45 BA/45 i-BMA/ 10 MAA | 3° C. | 9.35 | 75 | 75 | Partial | Complete | Good | Sl. Haze | Good-Exc. | Good-Exc. | 4.3 |
| 4B | 57 BA/31 VT 12 MAA | −1° C. | 9.26 | 75–100 | 75–100 | Partial | Complete | Exc. | No Change | Exc. | Good-Exc. | 4.1 |
| 4C | 58 BA/28 MeSt/ 14 AA | 1° C. | 9.16 | 75–100+ | 75–100 | Partial | Complete | Exc. | No Change | Exc. | Good-Exc. | 7.8 |
| 4D[1] | 57 BA/31 St/ 12 MAA | | | 75–100 | 75–100 | Partial | Complete | Exc. | No Change | Exc. | Good-Exc. | 3.5 |

[1]Example 4D is a repeat preparation of the latex of Example 2C
[2]Humidity during this test was 100% R. H. therefore results are slightly higher than normal 95% R. H. test.

EXAMPLE 5

Nylon Yarn

The procedure of Example 1 is followed with nylon yarn being substituted for the polyester yarn of Example 1. The nylon yarn employed is DuPont 70 denier, 34 filament, 0 twist yarn. The test results, in Table V below, show that the polymer of Example 4D compares favorably with materials commercially available. The nylon employed is identified as 70-34-R25 295 M. D. pirn 13073.

TABLE III

| Ex. | Composition | $T_g$ °C. | S. P. | Sand Tumble Dry | Sand Tumble Wet | Film Solubility (min.) | Removability from yarn | Water Resistance of films 20 mil | Water Resistance of films Mylar | Adhesion to Mylar Scrape | Adhesion to Mylar Crinkle | Moisture Regain (%) |
|---|---|---|---|---|---|---|---|---|---|---|---|---|
| 3A | 50.5 BA/37.5 MMA/12 AA | 4 | 9.2 | 75 | 75 | <15 | Complete | Good-Exc. | No Change | Good | Exc. | 5.0 |
| 3B | 48.5 BA/37.5 St/14 AA | 5 | 9.4 | 100 | ca. 100 | Partial | Complete | Exc. | No Change | Fair-Good | Good | 4.0 |
| 3C | 65 EA/22.8 MMA/12 MAA/ 0.2 EGDMA | 16 | 8.9 | 50 | 50 | <4 | Complete | Good | Hazy | Poor | Fair | 11 |
| 3D | 58.5 BA/37.5 St/4 AA | −9 | 9.1 | 75 | 75+ | Insol. | Almost Complete | Exc. | Sl. Haze | Exc. | Exc. | 4 |
| 3E | 46.5 BA/37.5 St/16 AA | 8 | 9.5 | 100 | 100 | Partial | Almost Complete | Fair-Good | Hazy | Good-Exc. | Exc. | 6 |

The latex of Example 3C is neutralized with ammonia to a pH of 7.5 and utilized as a solution.

EXAMPLE 6

Other Compositions

Polymer latexes of a number of different compositions applied to the yarn of Example 1 and films prepared from the latex have wet and dried adhesion which are acceptable as is the adhesion to Mylar by scrape and crinkle, the water-resistance of the film, the moisture regain, tack, solubility of the film, and removability of the polymer from the yarn. Polymer compositions, calculated $T_g$ values and solubility parameter values are given in Table VI.

TABLE V

| | Example 4D | Dow XD-8959.00 | ABCO BY-4 |
|---|---|---|---|
| Physical Properties | | | |
| Appearance | Milky white, fluid | White, fluid | Yellow, fluid |
| Solids | 29% | 25% | 21% |
| pH | 2.3 | 9.2 | 6.3 |
| Film (20 mil) | Firm, slightly brittle | Clear, pieces[1] | Yellow, hard and brittle |
| Composition | BA/St/MAA | Ethylene/Acrylic Acid[2] | BA/MMA/AN/Acid[2] |
| $T_g$ (measured) | 12° C. | 35° C. | 36° C. |
| Performance | | | |
| Sand Tumble[3], Dry | 100 | 100 | 75 |
| Wet | 75–100 | 75–100 | 50 |
| Removability, Yarn | Partial | Partial | Partial |
| Film Solubility | under 35 min. | over 38 min. | under 14 min. |
| Water Resistance (20 mil) | Excellent | Excellent | Very Poor |
| Moisture Regain | 4.0% | 2.0% | 24% |

[1]Does not form a continuous film on drying at room temperature.
[2]Acid content determined by neutralization is XD-8959.00 - 12%, BY-4 - 23%; unidentified minor components may be present.
[3]Nylon yarn sized using same conditions as polyester yarn - 8% solution.

TABLE VI

| EXAMPLE | COMPOSITION | $T_g$ | SOLUBILITIY PARAMETER |
|---|---|---|---|
| 6A | 45 BA/42 iBMA/13 AA | −2 | 9.39 |
| 6B | 57 BA/33 iBMA/10 MAA | −10 | 9.35 |
| 6C | 54 BA/32 MeST/14 AA | 8 | 9.10 |
| 6D | 58 BA/28 MeST/14 AA | 1 | 9.16 |
| 6E | 60 BA/28 MeST/12 MAA | 4 | 9.13 |
| 6F | 46 BA/40 VT/14 AA | 9 | 9.20 |
| 6G | 63 BA/28 VT/9 MAA | −10 | 9.16 |
| 6H | 51 2-EHA/ 41 MMA/8 AA | 6 | 9.36 |
| 6I | 63 2-EHA/ 28 MMA/9 MAA | −6 | 9.13 |
| 6J | 50 2-EHA/42 St/8 AA | 6 | 9.25 |
| 6K | 61 2-EHA/28 St/11 AA | −8 | 9.11 |
| 6L | 53 2-EHA/ 33 PMA/14 MAA | −5 | 9.11 |
| 6M | 41 2-EHA/ 45 PMA/14 AA | 0 | 9.18 |
| 6N | 60 2-EHA/ 26 EMA/14 MAA | −7 | 9.11 |
| 6P | 65 2-EHA/ 21 St/14 MAA | −7 | 9.18 |
| 6Q | 45 2-EHA/ 46 EMA/9 MAA | 5 | 9.11 |

I claim:

1. A method of sizing a hydrophobic yarn for weaving comprising the steps of (1) applying thereto an acid pH latex of a free radical initiated vinyl polymer having a weight average molecular weight of from about 300,000 to about 2,500,000; said polymer, in dried film form, being hydrophobic and not redispersible in a solution at a low pH and being redispersible in an alkaline aqueous medium; said polymer being of monomers having a solubility parameter from about 9.0 to about 9.5, a $T_g$ from about −20° C. and comprising 8% to about 14%, by weight, alpha, beta-ethylenically unsaturated acid, and (2) drying the yarn.

2. The method of claim 1, the yarn being of polyester or nylon, the polymer being of monomers selected from butyl acrylate, from styrene, acrylic acid, methacrylic acid, ethyl acrylate, 2 ethyl hexylacrylate, propyl acrylate and methyl acrylate, vinyl toluene, α-methyl styrene, acrylonitrile, ethyl meth-acrylate, butyl methacrylate and propyl methacrylate.

3. The method of claim 2 in which said monomers consist essentially of butyl acrylate, methyl methacrylate, styrene, acrylic acid and methacrylic acid.

4. The method of claim 3 in which said yarn is polyester.

5. The method of claim 3 in which said yarn is nylon.

6. The method of claim 4 in which said monomers consist essentially of 50 to 60% butyl acrylate, 28 to 40% styrene and 10 to 13% acrylic acid.

7. The method of claim 5 in which said monomers consist essentially of about 50–60% butyl acrylate, 28–40% styrene and 10–13% methacrylic acid.

8. Sized polyester yarn prepared by the method of claim 4 or 6.

9. Sized nylon yarn prepared by the method of claim 5 or 7.

10. A method of weaving comprising the steps of preparing a sized yarn in accordance with the method of claim 4, 5, 6, or 7, weaving the yarn into fabric, and removing said vinyl polymer therefrom by an aqueous alkaline solution.

11. The method of claim 10 in which the weaving is by a water jet loom.

12. A fabric prepared by the method of claim 10.

13. A polyester fabric prepared by the method of claim 11.

* * * * *

UNITED STATES PATENT AND TRADEMARK OFFICE

CERTIFICATE OF CORRECTION

PATENT NO. : 4,448,839

DATED : May 15, 1984

INVENTOR(S) : Hal C. Morris

It is certified that error appears in the above-identified patent and that said Letters Patent is hereby corrected as shown below:

In Claim 1, Column 12, line 5 after -20°C insert --to about 20°C--.

Signed and Sealed this

*Twenty-second* Day of *January 1985*

[SEAL]

*Attest:*

DONALD J. QUIGG

*Attesting Officer* *Acting Commissioner of Patents and Trademarks*